United States Patent [19]

Bayetto et al.

[11] Patent Number: 4,899,162

[45] Date of Patent: Feb. 6, 1990

[54] OMNIDIRECTIONAL CYLINDRICAL ANTENNA

[75] Inventors: Jean-Christophe M. Bayetto, Betton; Claude J. Vinatier, Rennes, both of France

[73] Assignees: L'etat Francais, Represente par le Ministre des PTT (CNET); Establissement Public de Diffusion dit Telediffusion de France, both of France

[21] Appl. No.: 220,993

[22] Filed: Jul. 13, 1988

Related U.S. Application Data

[63] Continuation of Ser. No. 869,412, Jun. 2, 1986, abandoned.

[30] Foreign Application Priority Data

Jun. 10, 1985 [FR] France ..... 85 08840

[51] Int. Cl.[4] ..... H01Q 21/20

[52] U.S. Cl. ..... 343/700 MS; 343/803; 343/853; 343/DIG. 2

[58] Field of Search ..... 343/700 MS, 705, 708, 343/727, 846–848, DIG. 1, 853, 803, 813, 890, 891

[56] References Cited

U.S. PATENT DOCUMENTS

| | | | |
|---|---|---|---|
| 3,713,166 | 1/1973 | Munson et al. | 343/700 MS |
| 3,747,114 | 7/1973 | Shyhalla | 343/795 |
| 3,813,674 | 5/1974 | Sidford | 343/803 |
| 4,054,874 | 10/1977 | Oltman | 343/700 MS |
| 4,079,268 | 3/1978 | Fletcher et al. | 343/700 MS |
| 4,162,499 | 7/1979 | Jones et al. | 343/708 |
| 4,528,568 | 7/1985 | Woloszczuk | 343/846 |
| 4,605,932 | 8/1986 | Butscher et al. | 343/708 |

FOREIGN PATENT DOCUMENTS

| | | | |
|---|---|---|---|
| 12244 | 1/1979 | Japan | 343/DIG. 2 |

*Primary Examiner*—Rolf Hille
*Assistant Examiner*—Michael C. Wimer
*Attorney, Agent, or Firm*—Laff, Whitesel, Conte & Saret

[57] ABSTRACT

An antenna array with circular symmetry made up of an array of cylindrically shaped printed circuit elementary antennas. It is made up of small radiating sources which are placed in superposed circles on a cylindrical surface. The sources are distributed at constant angular intervals on the circles. They have little coupling between themselves. On each circle of sources, they are energized in phase and with the same amplitude. An angular phase shift can be provided between the group of sources on a circle and those of another circle. The antenna can be energized by a three-layer printed circuit line. It can be made up by an array of doublets folded into sheets. Inside the cylinder the transmitter is installed to which is applied a signal to be transmitted and which supplies the modulated carrier to the array of radiating sources.

7 Claims, 5 Drawing Sheets

OMNIDIRECTIONAL CYLINDRICAL ANTENNA

This application is a continuation of application Ser. No. 6/869,412, filed June 2, 1986, now abandoned.

The present invention relates to a circular symmetry antenna array made up of an array of cylindrically shaped printed circuit boards, etched to provide elementary antennas (hereinafter called printed circuits) and is intended more particularly for the transmission of terrestrial radio broadcast signals in the 12 GHz band.

Terrestrial radio broadcast antennas must have an omnidirectional or very large sector transmission pattern in azimuth and a much narrower pattern in elevation.

Furthermore, the radiated power in a given direction must be constant relative to the frequency in the operating band of the antenna. To date, a number of technologies have been used with more or less success to obtain these patterns reflector antennas, slit antennas, dipole network, microstrip printed circuit source array.

The antennas using a technology other than that of printed circuits are too cumbersome to be installed at most sites In the state of the art, the basic idea was to bring back the phase pseudo-centre to the centre of the structure to achieve omnidirectional radiation. This has been achieved with multiple primary feed reflectors that are large and structurally heavy.

Flat printed circuit antennas have a directional radiation pattern. To achieve an omnidirectional pattern at 12 GHz, their arrangement becomes very delicate. In fact, it is necessary to achieve a partitioning of the different antennas with severe conditions on the phases to avoid unfavorable recombining of the radiation patterns from the elementary antennas. The radiation patterns must be large and have the most constant possible phase; otherwise, it is necessary to multiply the number of elementary antennas, which complicates the distribution of power.

In an article entitled "Large-Bandwidth Flat Cylindrical Array With Circular Polarization And Omnidirectional Radiation", by G. Dubost, J. Samson and R. Frin, published in 1979 in the journal "Electronics Letter" an array of four microstrip technology radiating sources with circular polarization which are plated on a cylinder, the distribution of power being done with coaxial cables and commercially available couplers is described. Such a radiating source with circular polarization is described in patent FR-A-No. 2 429 504.

One object of this invention consists in providing a printed circuit board array of elementary antennas plated on a cylinder being relatively small and which has a smoother azimuthal radiation pattern than those of present antennas. In accordance with a characteristic of the invention, the omnidirectional pattern is not obtained by bringing the phase centres of the elementary antennas to the centre of the structure, but by periodically placing these elementary antennas on a circumference centered on an axis of rotation and in sufficient number to obtain only small variations in the radiation pattern.

In accordance with a characteristic of the invention, such an antenna array is provided comprised of small radiating sources which are arranged in superposed circles on a cylindrical surface, the said sources being angularly distributed on the circles with a constant angular step, with little mutual coupling and for each circle of sources energized in phase and with the same amplitude.

In accordance with another characteristic, an angular phase shift is provided between the sources of one circle and the sources of the next circle.

In accordance with another characteristic, the phase shift is a fraction equal to the angular step divided by the number of circles.

In accordance with another characteristic, the antenna array is energized by a three layer printed circuit board line coated on a cylinder.

The use of a three layer line creates a shielded area inside the cylinder. The energizing conductors being under the external mass surface, are also completely shielded.

In other respects, in the article entitled "Réseau de doublets repliéssymètriques en plaques à large bande autour de 12 GHz", by G. Dubost and C. Vinatier published in the journal "Londe electrique" 1981, Vol. 61, No. 4, pp. 34–41, a flat radiating source is described whose radiating elements are folded doublets and which is energized by a three layer line. This array is also described in the documents FR-A-No. 2 487 588 and EP-A-No. 0 044 779. Among other things, this array leads to directional patterns when it is flat.

Another object of the invention is the use of this type of array to realize an antenna array with circular symmetry having a practically omnidirectional radiation pattern, that is whose variations in the plane perpendicular to the axis of symmetry are slightly smaller in comparison with those obtained from antennas with the present state of the art.

In accordance with a characteristic of the invention, an antenna is provided made up of an array of doublets folded into plates of the same type as those described in the above mentioned document FR-A-No. 2 487 588, the doublets being circularly aligned, the distance between the centres of adjacent doublets being of the order of 0.9 $\lambda o$, where $\lambda o$ is the wavelength of the transmitted carrier in a vacuum.

In accordance with another characteristic, the transmitter to which is applied the video signal to be transmitted and which supplies the modulated carrier to the radiating array of sources is installed inside the cylinder.

This structure offers the advantage of reducing to a minimum the length of conductor travelled by the high frequency signal which limits the losses and increases the radiation of the transmitter.

In accordance with another characteristic, the array of radiating sources is divided into subarrays, each subarray covering an angular section, the output of the transmitter being connected to an equal phase and equal amplitude power divider having as many outputs as subarrays and whose outputs are respectively connected to the attack point of the subarrays.

The above mentioned characteristic of the invention, as well as others, will become clearer upon reading the following description of embodiments, the said description being done in relation to the attached drawings, among which:

Figure 3:
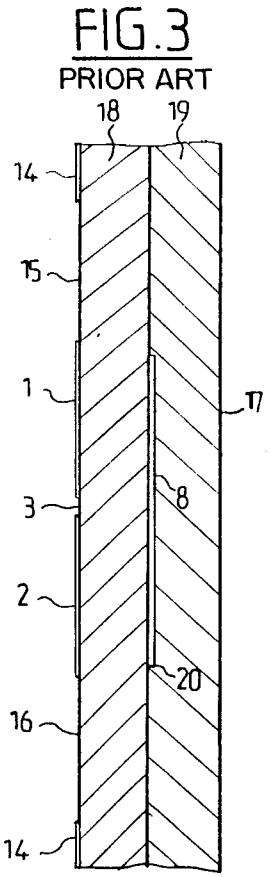
FIG. 3 PRIOR ART
Figure 1:
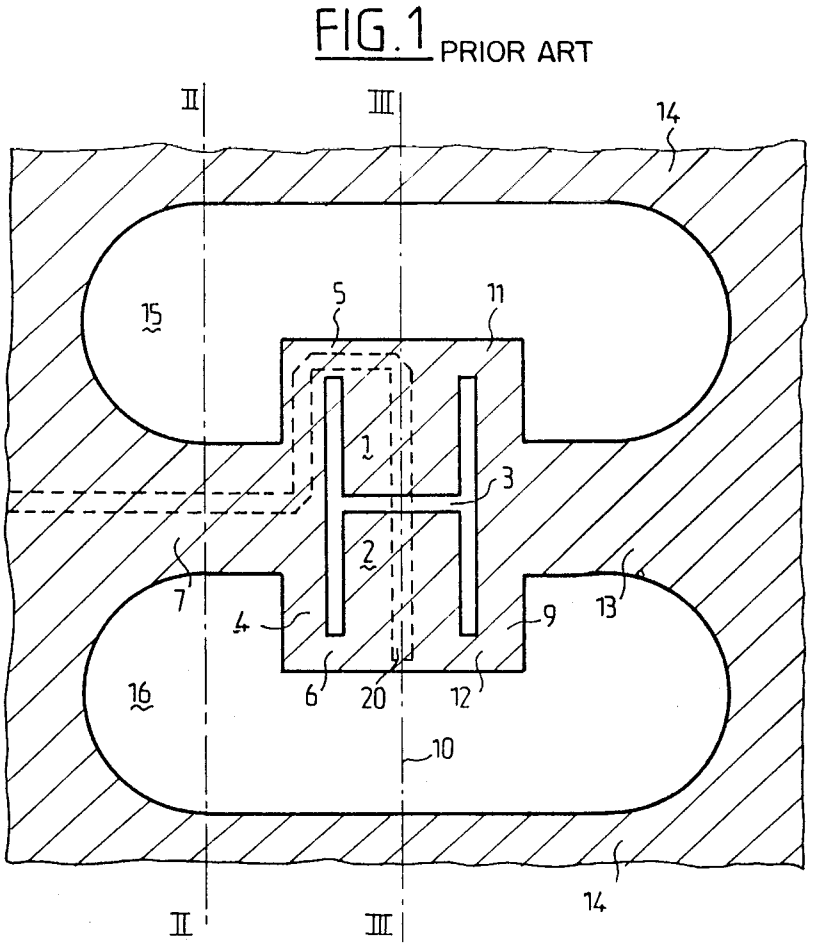
FIG. 1 PRIOR ART
FIG. 1 is a top view of a known folded plate doublet.
Figure 4:
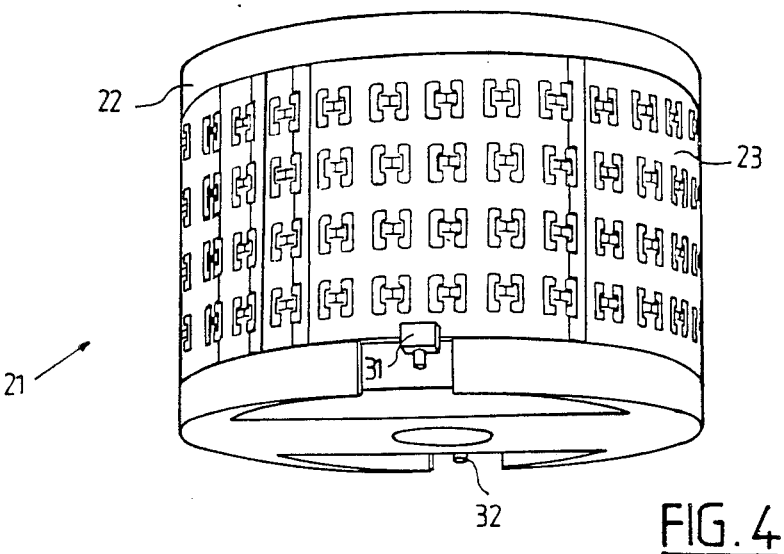
Figure 5:
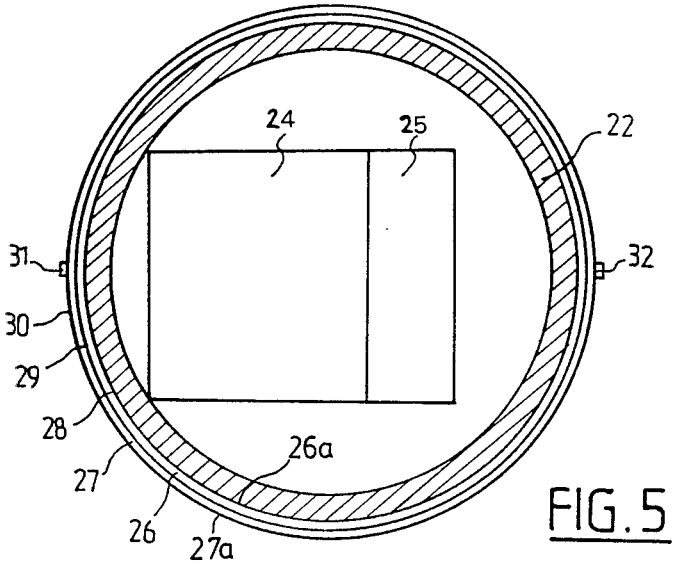
Figure 6:
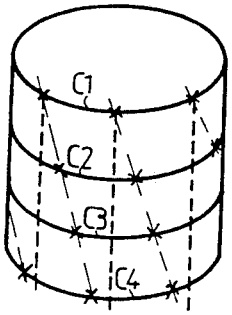
Figure 7:
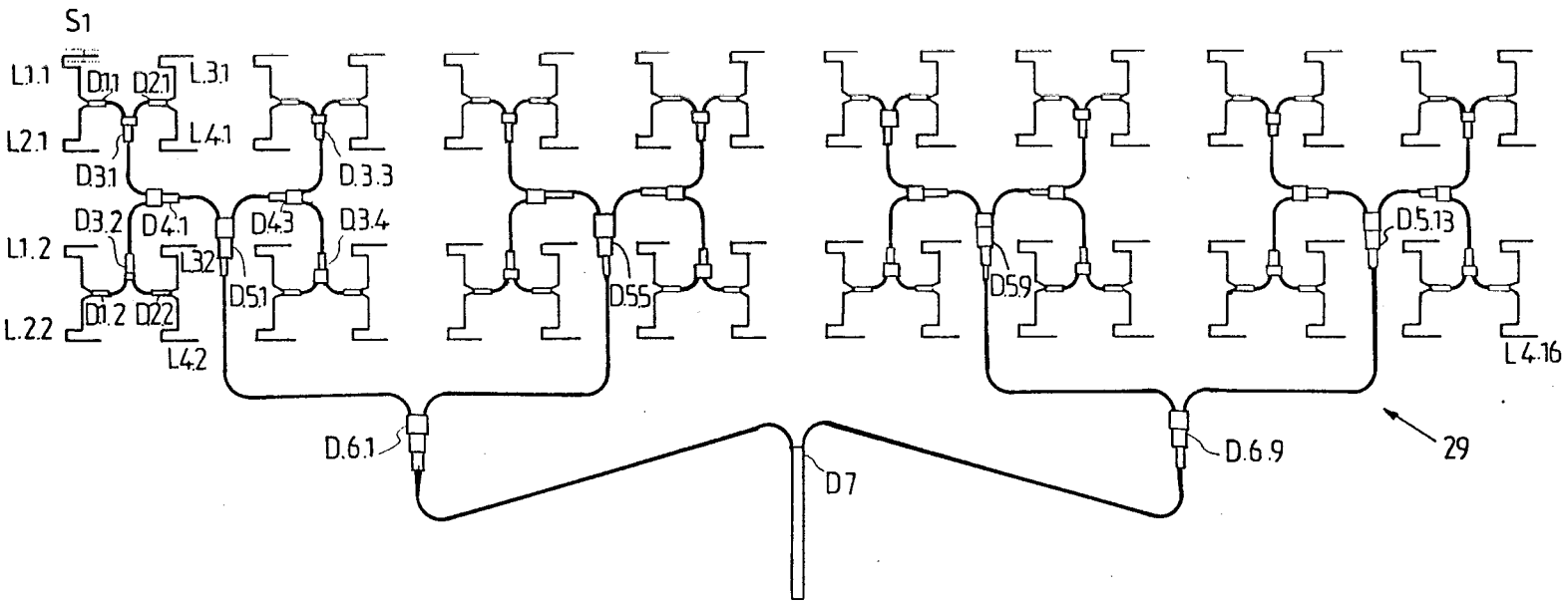
Figure 8:
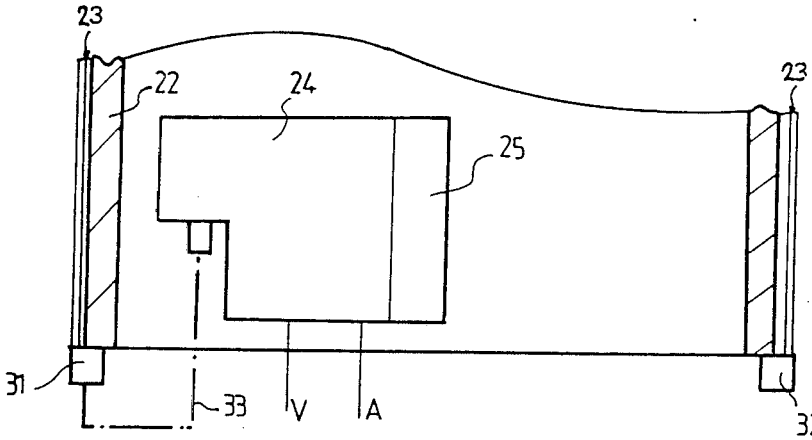
Figure 9:
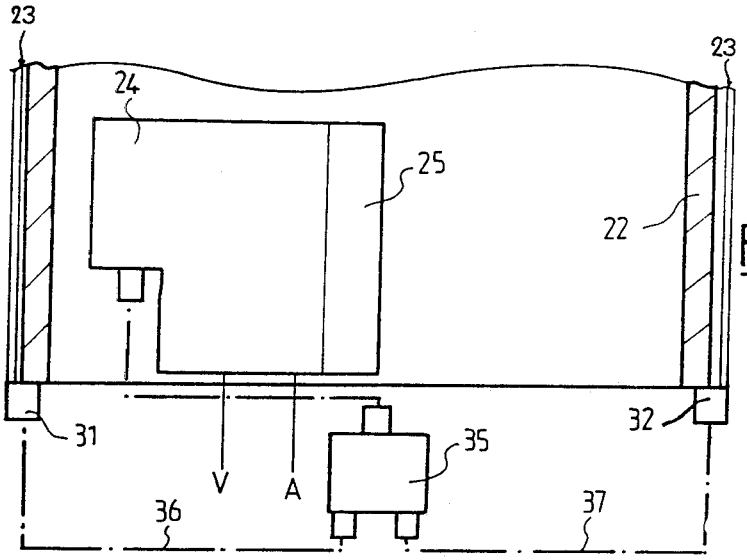
Figure 10:
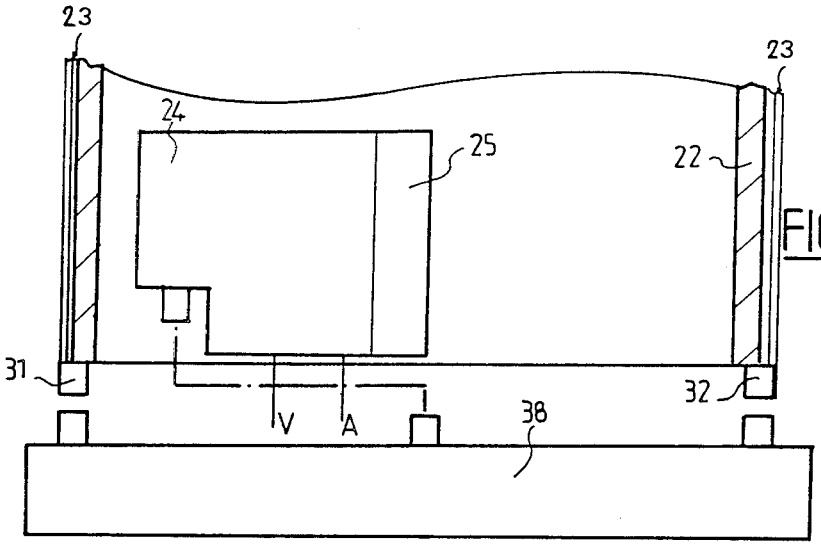
Figure 12:
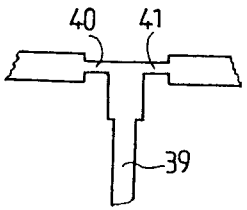
Figure 11:
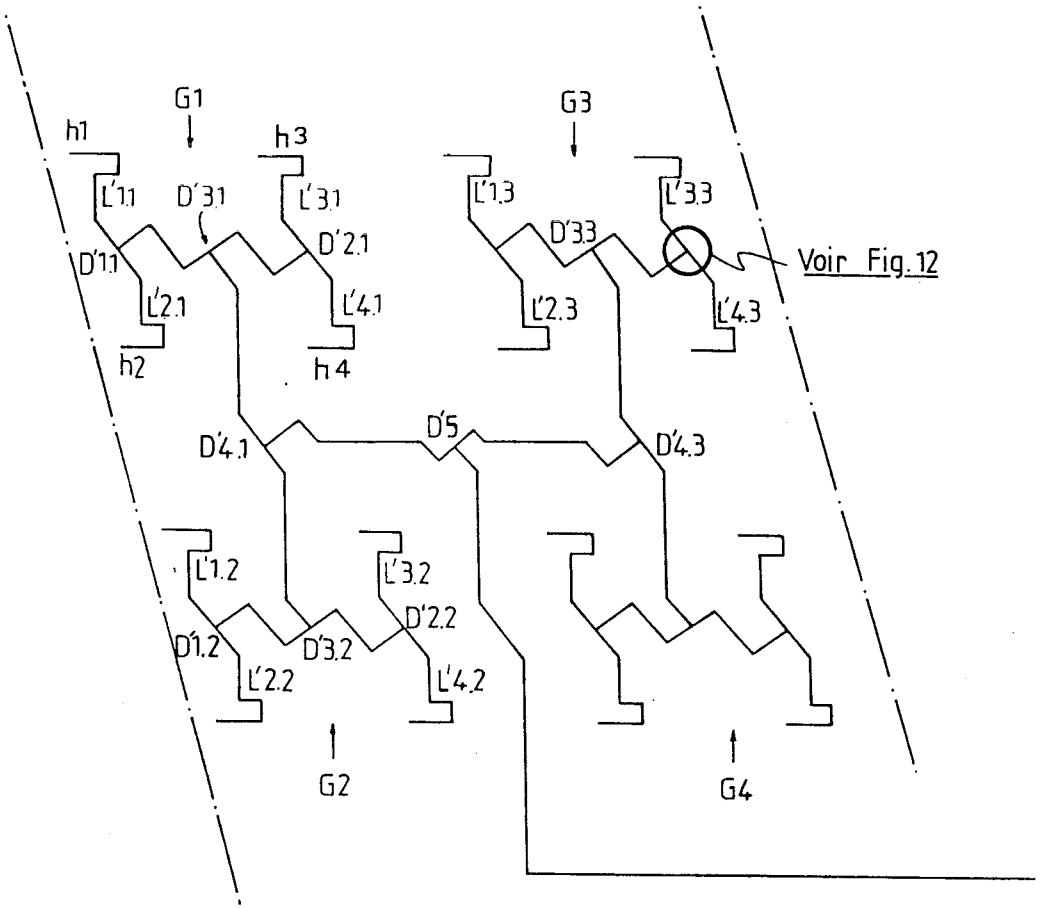

FIG. 3 is a sectional view of the doublet of FIG. 1, along line III—III, FIG. 4 is a perspective view of a vertical axis cylindrical antenna, in accordance with the invention, FIG. 5 is a transversal sectional view of the antenna of FIG. 4, FIG. 6 is a schematic view illustrating a variation of FIG. 4, FIG. 7 is an unfolded view of a distribution subnetwork energizing a subarray of radiating sources, FIGS. 8 to 10 are partial vertical sectional views of a number of distribution structures of the antenna of FIGS. 4 and 5, FIG. 11 is a view of a variation of the distribution network of FIG. 10, and FIG. 12 is a large scale view of a detail of the network of FIG. 11.

An elementary antenna useable in the antenna array of the invention can be the folded doublet shown in FIG. 1 and which makes, when it is flat, part of the state of technology. As will be seen below, we use this elementary antenna by giving it a cylindrical form. The doublet of FIG. 1 has an energized strand formed by two half-plates 1 and 2 separated by a cut 3, and a folded strand made up from a long continuous sheet 4 and of two symmetric portions 5 and 6 connecting, on one hand, 1 and 4 and, on the other hand, 2 and 4.

The plate 4 is connected, at its middle part, to a grounding sheet 7, that is symmetrical and perpendicular to 4, with respect to the symmetry axis the doublet, of the centre conductor 8 of a three conductor layer feed line. The centre conductor 8 is shown in FIG. 1 by dashes because it passes in succession under 7, 4 5, and 1, each of the metallic surfaces 7, 4, 5 and 1 serving as grounding surface for one side of conductor 8. In particular, under half-sheet 1, the line 8 is at equal distance of the sides of 1.

Furthermore, the doublet of FIG. 1 comprises a second long continuous sheet 9, symmetric to sheet 4 with respect to the symmetry axis 10 of the two half-sheets 1 and 2, and two symmetric parts 11 and 12 connecting, on one hand, 1 and 9 and, on the other hand, 2 and 9. The parts 11 and 12 are symmetric to the parts 5 and 6 with respect to axis 10.

The sheet 9 is connected, in its middle part, to a sheet 13 perpendicular to 9 and symmetrical to 7 with respect to axis 10. The sheets 7 and 13 are part of the same large sheet 14 which circles the doublet proper, with openings 15 and 16 separating the doublet of sheet 14. Of course, the openings 15 and 16 are symmetric with respect to the centre of the doublet.

Figure 2:
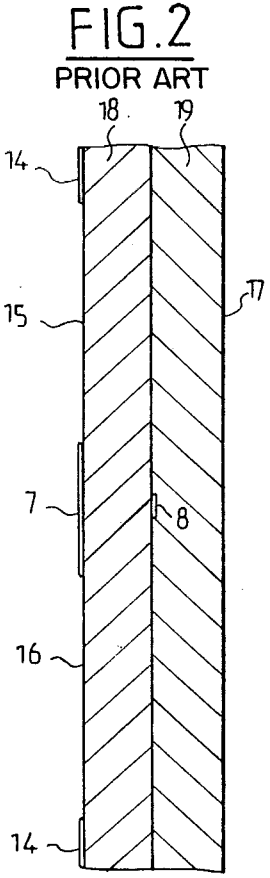
FIG. 2 PRIOR ART
FIG. 2 is a sectional view of the doublet of FIG. 1, along line II—II.

As shown in the section of FIG. 2, the centre conductor 8 forms with sheet 7, on one hand, and a grounding sheet 17, on the other hand, a three-layered energizing line. In practice, the metallic elements 1, 2, 4, 5, 6, 7, 9, 11, 12, 13 and 14 make up one side of a first printed circuit board 18 while the centre conductor 8 makes up the other side of that printed circuit board. Against the side of 18 carrying conductor 8, is applied the bare side of a second printed circuit board 19 whose other side is evenly coated with the metallic sheet 17.

The openings 15 and 16 must be sufficiently large to avoid excessive coupling between the radiating doublet and the grounding sheet of the three-layered line.

Fotm sheet 7, the central conductor 8 is in succession extended under one-half of sheet 4 (towards part 5), then under part 5, then under half-sheet 1, and finally, after passing under cut 3, under a part of half sheet 2. Of course, each of the different parts making up the central conductor is always under the symmetry axis of the sheet that covers it.

The distance between the end 20 of conductor 8 and the middle of cut 3 is equal to a quarter wavelength, that is $\lambda/4$, where $\lambda$ designates the wavelength in the insulating material of printed circuit boards 18, 19, with:

$$\lambda = \frac{c}{f\sqrt{\epsilon r}}$$

where c is the velocity of electromagnetic waves in a vacuum.

Thus, the quarter wavelength line under half sheet 2 is open, which reflects a short circuit under the edge of half sheet 2 adjacent to cut 3. It is thus apparent that the quarter wavelength line avoids the need to go through circuit 18 and a solder.

The detailed description which has just been given has the sole purpose of illustrating an embodiment of a radiating elementary source and should not be construed as limiting the scope of the invention to this type of radiating source In fact, with a three layer sheet we can use open slits in the exterior grounding sheet of the line. It should, however, be noted that the doublet of FIGS. 1 to 3 constitutes a wide bandpass radiating source.

The antenna 21 of FIG. 4 is made up of a hollow support cylinder 22, which is obtained, for example, by rolling and machining, and antenna subarrays 23 which are plated to the exterior side of cylinder 22 through adequate means, not shown, such as screws which are screwed into threaded holes in the side of cylinder 22. In the said example, the elementary radiating sources of the subarrays 23 are doublets identical to that of FIGS. 1 to 3. A subarray of four horizontal rows of sixteen doublets each is plated on one-half of cylinder 22.

The interior of cylinder 22 allows the location of the active portion of the antenna, that is the transmitter, which conventionally has a video input, a direct current source and a high frequency output. Finally, a radiator 25 can be added to guarantee the cooling of the transmitter. The transmitter and the radiator are supported by horizontal plates which are themselves attached at different points of the internal side of cylinder 22. These plates are cut out to the greatest possible extent to allow air to circulate from the bottom to the top of the transmitter and the radiator, as well as holes to pass the video cable and power.

The horizontal cross section of FIG. 5 illustrate, wrapped around the cylinder 22, the two coatings of printed circuit boards 26 and 27 having the radiating sources with, on the interior side 26*a* of coating 26, the ground plane 28, on the interior side of coating 26, the centre conductor of the power distribution network 29 and, on the exterior side 27*a* of coating 27, the second ground plane 30 in which cut-outs show the blades of the doublets that make up the array 23.

In practice, the structure of the assembly 26 to 30 forms a three layered structure identical to that which is described in relation to FIGS. 1 to 3 with all its inherent advantages with regards to the shielding of the power distribution lines, that is of network 29.

Furthermore, it is necessary to note that the ground plane 28 prevents spurious radiations coming from the transmitter to be transmitted outside.

In FIG. 7, we have shown the unfolded representation of the central conductor of the distributions subarray 29 usable with subarray 23. For convenience in presentation, instead of considering the elementary sources grouped into four circular rows, we shall consider that the network of FIG. 7 comprises sixteen groups of four radiating sources, from which a signal is represented in S1 by a H in dashed line, with their source conductors L1.1 to L4.16, similar, to 8, FIG. 3. Each group i has four conductors L1.i to L4.i. We recall, as shown in Figure 1, that each supply conductor 8 has an end section parallel to the blades of the doublet and an initial section which is directed perpendicularly to the end section towards the centre of this one, the two sections being united by an elbow.

The initial sections of conductors L1.i and L2.i are connected by a division by two power divider D1.i directed parallel to the end sections. The initial sections of conductors L3.i and L4.i are connected to a divide by two power divider D2.i aligned with divider D1.i, but along the opposite direction. The inputs of dividers D1.i and D2.i are respectively connected to the two outputs of a divide by two power divider D3.i which is parallel to the initial sections. The set of four conductors L1.i to L4.i and the three dividers D1.i to D3.i makes up the energizing group of a group of four radiating sources. In such a group, the middles of the individual sources are at the four corners of a square and the end sections are all aimed in the same direction.

The groups of radiating sources are arranged into groups of four in the following manner. By supposing that j is a multiple of four, plus one, the middles of the squares of the groups j to j+3 are themselves at the four corners of a square, with their dividers D3.j and D3.(j+1) aligned, but directed one towards the other, and their dividers D3.(j+2) and D3.(j+3) aligned, but directed one towards the other. The inputs of dividers D3.j and D3.(j+1) are connected to the outputs of a divide by two power divider D4.j while the inputs of dividers D3.(j+2) and D3.(j+3) are connected to the outputs of a divide by two power divider D4.(j+2). The dividers D4.j and D4.(j+2) are aligned in parallel with the end sections, but with their inputs directed one towards the other and connected to the outputs of a divide by two power divider D5.j.

Given that there are sixteen groups themselves arranged four by four, there are four dividers D5.1, D5.5, D5.9 and D5.13 which are all orthogonal to the end blades. The inputs of dividers D5.1 and D5.5 are connected, by two equal length conductors, bent twice, to a divide by two power divider D6.1 Similarly, the inputs of dividers D5.9 and D5.13 are connected to a divide by two power divider D6.9. The dividers D6.1 and D6.9 are orthogonal to the end sections, pointed in the same direction, and their inputs are connected to the inputs of a divide by two power divider D7 which is parallel to them, pointed in the same direction and in the vertical axis of symmetry of the array when it is unfolded on a plane. The input of divider D7 is vertically extended up to a hook-up point to a connector.

In the embodiment of FIG. 7, we have considered a distribution network for four times sixteen radiating sources. To progress to an array of four times to thirty-two antennas, we could place side by side two arrays of 4x16 by providing the uniting of the inputs of divider D7 and of its corresponding unit to a divider D8.

In an embodiment of the invention, the angular step of subarray 23 was, in the two directions, horizontal and vertical, equal to 0.9 times the wavelength of the 12 GHz carrier in a vacuum, and two subarrays were plated on a cylinder of 33 cm in diameter. An array having four rows of sources requires a cylinder of approximately 13 cm high.

As shown in FIGS. 4 and 8 to 10, the antenna has been provided with two antenna connectors 31 and 32 diametrically opposed 35.

In FIG. 8, a single coaxial link 33 has been provided between the transmitter 24 and the connector 31. Above connector 31, an array 23 has been plated whose distribution network was identical to that of FIG. 7, with the input conductor of divider D7 extended vertically towards the bottom of connector 31. The transmitter 24 is modulated by the video carried by cable V and energized by the electric power cable A.

In FIG. 9, the source 24 is connected, by a coaxial link, to the input of a divide by two power divider 35 whose outputs are respectively connected by equal phase and equal amplitude coaxial links 36 and 37, to the connectors 31 and 32. In this case, each connector 31 and 32 is connected to a distribution network identical to that of FIG. 7. The two subarrays together cover the complete exterior of the cylinder and allow a coverage of 360°.

The configuration of FIG. 10 is a variation of that of FIG. 9, in which divider 35, which can be a commercially available 3dB divider, has been replaced by a variable power divider 38 designed for equal phase and equal amplitude outputs.

With the arrangement of FIG. 8, the diameter of cylinder 22 being 22 cm, the measurements carried out have shown that a satisfactory horizontal coverage of 165° was obtained, variations in the horizontal radiation pattern of the Order of ±3 dB, a 3 dB vertical beamwidth corresponding to a 16° angle and a horizontal polarization.

With the arrangement of FIG. 9 and the same cylinder, these results become ±3 dB, omnidirectional, 16° and a horizontal polarization.

In FIG. 6, we have shown a schematic variation of the array shown in FIG. 4. In this array, where the elementary radiating sources are represented by crosses, these are distributed on four horizontal circles C1 to C4. There are the same number of sources N on all the circles and the angular step between adjacent sources is 360°/N. The distribution of sources on circle C2, below C1, has an angular offset of 360°/(4×N) and so on until the distribution of circle C4. As shown in FIG. 3, with sixteen sources over 180°, the angular step is equal to 11°15′. The variations of the pattern thus have a periodic variation of 11°15′. The period of the variations is reduced to less than 3° with the antenna of FIG. 6. We must observe that when the period of the variations is reduced, its amplitude is also reduced.

The distribution network of FIG. 11 is adapted to such an antenna. Experience has shown that the amplitudes of the variations were reduced to below ±1.5 dB.

In the network of FIG. 11, the successive divide by two power dividers are not dividers achieved by simply enlarging the input conductor and outputting on two conductors without a change of direction, but T dividers as shown in FIG. 12.

The T divider of FIG. 12 has an input conductor extended by a quarter-wave transformer, then extended by two quarter-wave transformers 40 and 41, perpendicular to the direction of conductor 39.

More particularly, the distribution network of FIG. 11 is provided to energize a subarray of 4×4 sources. In a group of sources such as group G1, the sources h1 and h2, on two different circles, are shifted by a quarter step. As a result the input sections of their energizing conductors L'1.1 and L'2.1 are not aligned. In the embodiment, they are respectively connected to the output conductors of a divide by two T divider whose output conductor direction makes an angle of +45°. Similarly, the conductors L'3.1 of h3 and L'4.1 of h4 are connected to a T divider D'2.1 whose input conductor is directed at −135°. It should be noted that the dividers D'1.1 and D'2.1 are, in order to maintain similar paths, on the same horizontal circle. Thus their input conductors are not aligned. These are then extended by bending the first by −90° then by +90°, and the other by +90° then by −90° in order to reach the output conductor of a T divider D'3.1 whose input conductor is pointed at −45°.

For the sources of group G2, the conductors L'1.2 and L'2.2, as well as L'3.2 and L'4.2 respectively are not aligned. They are connected to a divide by two T divider D'3.2 similar to those that have been described. The input conductor of divider D'3.2 is aimed at +135°. The input conductors of D'3.1 and D'3.2 are connected by elbowed conductors at −45° and +45°, then at −45° and +45°, respectively to the output conductors of a divider D'4.1. The output conductor of divider D'4.1 is directed at +45°. In the groups G3 and G4, we find in the same manner one divider D'4.2 whose input conductor is directed at −135°.

The input conductors of D'4.1 and D'4.2 are respectively extended by elbows at −90°, then +45° and finally −45°, to be connected to the output conductors of a divider D'5 whose input conductor is at −45°.

The input conductor of D'5 is connected by a suitably bent conductor, to an input connector such as 31 or 32 or to dividers in cascade, not shown, the input of the last of which is tied to a connector.

As mentioned above, a satisfactory omnidirectional antenna can be made up by a printed circuit plated on a 22 cm diameter cylinder for a height of 13 cm, the transmitter being connected on the inside of the cylinder. It is quite feasible to superpose a number of these antennas each containing a transmitter operating with a different carrier and modulated by a different video signal to transmit as many different programs. This solution is particularly beneficial since it avoids the need to multiplex programs as well as the inherent power limitations required to reduce the effects of intermodulations.

It should also be noted by using as elementary radiating sources doublets such as shown in FIGS. 1 to 3 which have a wide band, the superposed antennas can be made up by similar arrays.

We claim:

1. An antenna array with a circular symmetry, said antenna comprising a cylindrical surface having a circumference; an array of elementary radiating sources in three layer printed circuits, each elementary radiating source being applied on said cylindrical surface; a plurality of said elementary radiating sources being arranged in successive circular rows which are longitudinally distributed across said cylindrical surface; said elementary radiating source centers in each circular row being angularly separated by a constant angular step, the sizes, angular width and longitudinal length of each elementary radiating source being substantially smaller than the circumference of the cylindrical surface; each elementary radiating source having, when still planar and before being applied onto said cylindrical surface, a linearly polarized directive diagram; adjacent elementary radiating source centers being separated by a distance in the order of 0.9 λo, where λo is the free space wavelength of a carrier frequency transmitted by the antenna, all said elementary radiating sources being fed in phase by signals having the same amplitude through a three conductor layer feed triplate line.

2. An antenna array in accordance with claim 1 in which a transmitter is installed inside a cylinder having said cylindrical surface, a video signal being applied to said transmitter to be transmitted and said transmitter supplying a carrier modulated by the video signal to the array of radiating sources.

3. An antenna array in accordance with claim 1 in which the array of radiating sources is divided into subarrays, each subarray covering an angular section of said circumference, and transmitter means having an output connected to an equal phase power divider having a plurality of outputs, said equal phase power divider having as many outputs as there are subarrays and having outputs which are respectively connected to the subarrays.

4. An antenna array in accordance with claim 1 in which an angular shift of (360°/4N) is provided between the radiating sources of one circular row and the radiating sources of the next circular row.

5. An antenna array in accordance with claim 1 in which an angular shift is provided between the radiating sources of one circular row and the radiating sources of the next circular row, said angular shift being a fraction which is equal to the angular shift divided by the number of said successive circular rows.

6. An antenna array in accordance with claim 1 in which a number of said antenna arrays are positioned along a common vertical axis, each of said antenna arrays having a transmitter inside the cylindrical surface of said antenna arrays, each of said transmitters inside the cylindrical surfaces being modulated by a video signal which is to be transmitted.

7. An antenna in accordance with claim 1 wherein said antenna operates in the region around 12 GHz, and thirty-two of said sources are provided in each circular row, the diameter of the cylindrical surface being 22 cm.

* * * * *